US005490446A

United States Patent [19]

Engel

[11] Patent Number: 5,490,446

[45] Date of Patent: Feb. 13, 1996

[54] APPARATUS AND METHOD FOR A PISTON ASSEMBLY

[75] Inventor: William K. Engel, Peoria, Ill.

[73] Assignee: Caterpillar Inc., Peoria, Ill.

[21] Appl. No.: 215,430

[22] Filed: Mar. 22, 1994

[51] Int. Cl.[6] ..... F01B 31/10

[52] U.S. Cl. ..... 92/157; 92/188; 29/888.047; 29/888.048; 403/140

[58] Field of Search ..... 22/70, 71, 110, 22/140, 187, 188, 191; 29/888.044, 888.047, 888.048, 458; 403/135, 139, 140; 92/157

[56] References Cited

U.S. PATENT DOCUMENTS

| | | | |
|---|---|---|---|
| 1,966,619 | 7/1934 | Fick | 92/71 |
| 3,120,816 | 2/1964 | Firth et al. | 92/110 |
| 3,212,483 | 10/1965 | Balzer | 92/187 |
| 3,342,513 | 9/1967 | Melton et al. | 403/135 |
| 3,707,113 | 12/1972 | Hein et al. | 29/888.044 |
| 3,787,128 | 1/1974 | Maistrelli | 403/135 |
| 3,893,375 | 7/1975 | Hein et al. | 91/486 |
| 4,290,181 | 9/1981 | Jackson | 29/458 |
| 4,475,443 | 10/1984 | Forster | 91/499 |

FOREIGN PATENT DOCUMENTS

| | | | |
|---|---|---|---|
| 129962 | 8/1982 | Japan | 92/187 |
| 795987 | 6/1958 | United Kingdom | 403/140 |
| 909145 | 10/1962 | United Kingdom | 92/71 |

*Primary Examiner*—F. Daniel Lopez
*Attorney, Agent, or Firm*—J. W. Burrows

[57] ABSTRACT

An apparatus and method is provided for producing a piston assembly for use in a fluid translating device such as a hydraulic pump or motor. In the subject arrangement, a piston is provided having a cavity at one end thereof and a slipper having a spherical head portion which is precisely positioned within the cavity to provide a space therearound and subsequent thereto a plastic material is formed in the space to maintain the spherical head portion in the cavity. This arrangement eliminates the sliding friction that exists in other piston assemblies and furthermore reduces the precise sizing of the cavity relative to the spherical head portion.

7 Claims, 11 Drawing Sheets

APPARATUS AND METHOD FOR A PISTON ASSEMBLY

TECHNICAL FIELD

This invention relates generally to a piston assembly for use in a fluid translating device such as a hydraulic pump or a hydraulic motor and, more particularly, to the interface between the elements of the piston assembly.

BACKGROUND ART

Piston assemblies normally used are made of steel and hardened to increase their wear life. In the known piston assemblies, a slipper is pivotally connected to a piston so that one part can pivot relative to the other. In these piston assemblies, a spherical cavity is in one of the components and a spherical ball is disposed on the other component. Upon assembly, the spherical ball is placed in the spherical cavity and mechanically retained therein. During all pivotal movement of the spherical ball in the spherical socket, the outer surface of the spherical ball is in sliding contact with the surface of the spherical cavity. Since there is sliding contact and heavy loading between the spherical ball and the spherical cavity, a lubricant is continually needed between the surfaces in order to eliminate scoring and/or seizing of the surfaces. The sliding friction between the metal surfaces creates undesirable heat and wear between the components. Furthermore, it is necessary to maintain close tolerances of size, sphericty, and surface finish on the spherical ball and the cavity that it fits into.

The present invention is directed to overcoming one or more of the problems as set forth above.

DISCLOSURE OF THE INVENTION

In one aspect of the present invention, a piston assembly is provided and adapted for use in a fluid translating device. The piston assembly includes a piston, a slipper, and a plastic material disposed between the piston and the slipper. The piston has a longitudinally extending body with a cavity in one end thereof defined by an irregularly shaped annular surface adjacent the end thereof and a concave spherical surface extending from the irregularly shaped annular surface. The slipper has a first end portion with a load bearing end surface and a neck portion and a second end portion with a larger head portion extending from the neck portion. The head portion has a convex spherical surface and is disposed in the cavity to define a space between the convex spherical surface and the irregularly shaped annular surface and the spherical concave surface. The plastic material is formed in the cavity and extends inwardly from the end of the piston filling the space. The plastic material is sufficient to pivotally retain the head portion of the slipper in the cavity of the piston.

In another aspect of the present invention, a method of assembling a piston assembly is provided. The piston assembly has a piston with a cavity in one end thereof defined by an irregularly shaped annular surface and a concave spherical surface and a slipper having a first end portion with a load bearing end surface and a neck portion and a second end portion having a larger head portion with a convex spherical surface. The head portion extends from the neck portion. The steps of the method of assembling the piston assembly includes precisely positioning the head portion of the slipper in the cavity of the piston with the convex spherical surface being spaced from the irregularly shaped annular surface and the concave spherical surface to define a space therebetween and forming a plastic material in the space to secure the head portion in the cavity.

The present invention provides a piston assembly that utilizes a plastic material in the cavity between the concave spherical surface of the cavity and the convex spherical surface of the head portion of the slipper which totally eliminates any sliding contact between the metal surfaces and eliminates the need to precisely control the size of the head portion relative to the size of the cavity. Also the shape and size of the cavity does not need to be closely controlled. Furthermore, the plastic material is utilized to effectively retain the head portion of the slipper within the cavity of the piston.

BEST MODE FOR CARRYING OUT THE INVENTION

Figure 1:
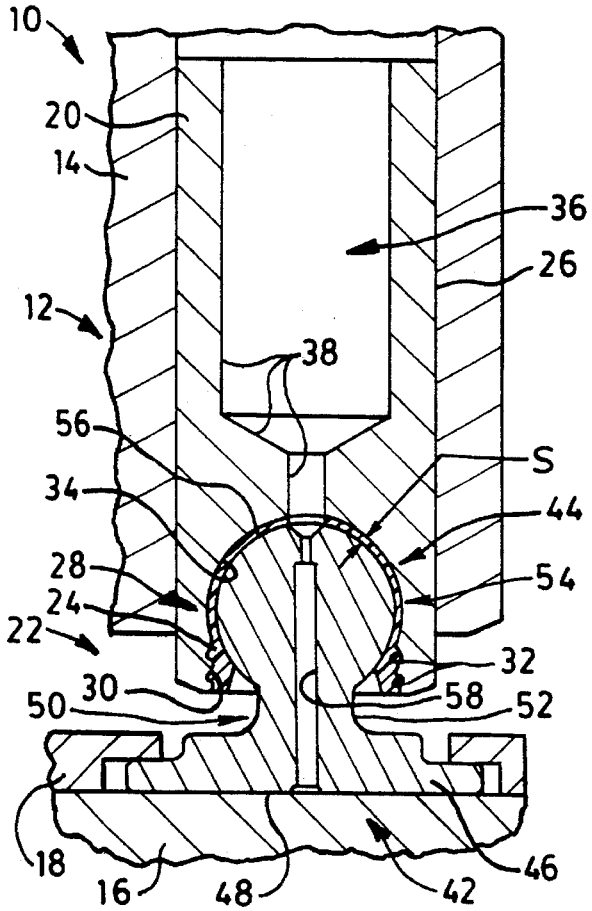
FIG. 1 is a diagrammatic representation of a piston assembly generally shown in its operating environment and illustrating an embodiment of the present invention.

Referring to the drawings and more particularly to FIG. 1, a piston assembly 10 is illustrated and adapted for use in a fluid translating device 12 (partially shown). The portions of the fluid translating device 12 that are illustrated herein include portions of a barrel 14, a swashplate 16, and a slipper retainer 18. Fluid translating devices 12, such as hydraulic pumps and/or hydraulic motors having piston assemblies therein are well known to those skilled in the art. Likewise, since the operation of a fluid translating device is well known, additional details of its operation will not be set forth herein.

The piston assembly 10 includes a piston 20, a slipper 22 and a plastic material 24 disposed between the piston 20 and the slipper 22. The piston 20 has a longitudinal cylindrical body 26 with a cavity 28 defined in one end thereof. The cavity 28 has a concave surface. As illustrated, the cavity 28 has an irregularly shaped annular surface 30 adjacent the end of the cavity 28 with a plurality of cylindrical grooves 32 defined in the irregularly shaped annular surface 30. Even though a plurality of cylindrical grooves 32 is illustrated, it is recognized that the irregularly shaped annular surface 30 could have only one cylindrical groove 32 without departing from the essence of the invention. Likewise, the shape of the cavity 28 could be different than that illustrated and the cylindrical grooves 32 in the irregularly shaped annular surface 30 could be eliminated. A concave spherical surface 34 is disposed in the cavity 28 extending from the irregularly shaped annular surface 30. An opening 36 is defined in the piston 20 and extends from the other end of the piston 20 through the longitudinal body 26 to the cavity 28. A peripheral surface 38 is disposed on the piston 20 along the entire length of the opening 36. Even though the opening 36 is illustrated as a stepped bore, it is recognized that the opening 36 could have various shapes without departing from the essence of the invention.

The slipper 22 has a first end portion 42 and a second end portion 44. The first end portion 42 has a base portion 46 with a load bearing end surface 48 and a neck portion 50. It is recognized that the load bearing end surface 42 could be substantially flat, as illustrated, or of various shapes depending on the application. The neck portion 50 includes a stem 52. The second end portion 44 has a head portion 54 that is larger than the neck portion 50 and extends from the neck portion 50. A convex spherical surface 56 is disposed on the head portion 54. A lube passage extends through the slipper 22 from the load 58 bearing end surface 48 to the convex spherical surface 56. As is well known, the load bearing surface 48 could be modified by one of several fluid film-promoting patterns.

The head portion 54 of the slipper 22 is smaller than the cavity 28 of the piston 20. When the head portion 54 is positioned within the cavity 28, a space "S" is defined between the convex spherical surface 56 of the head portion 54 and both the concave spherical surface 34 and the irregularly shaped annular surface of the cavity 28. During assembly, the space "S" between the head portion and the cavity is filled with the plastic material 24. Once the plastic material 24 is formed or solidified in the aforementioned space "S", the head portion 54 is pivotally retained in the cavity 28. It is well recognized that the space "S" does not have to be a uniform thickness. The thickness may vary depending on the shape of the cavity 28.

Figure 2:
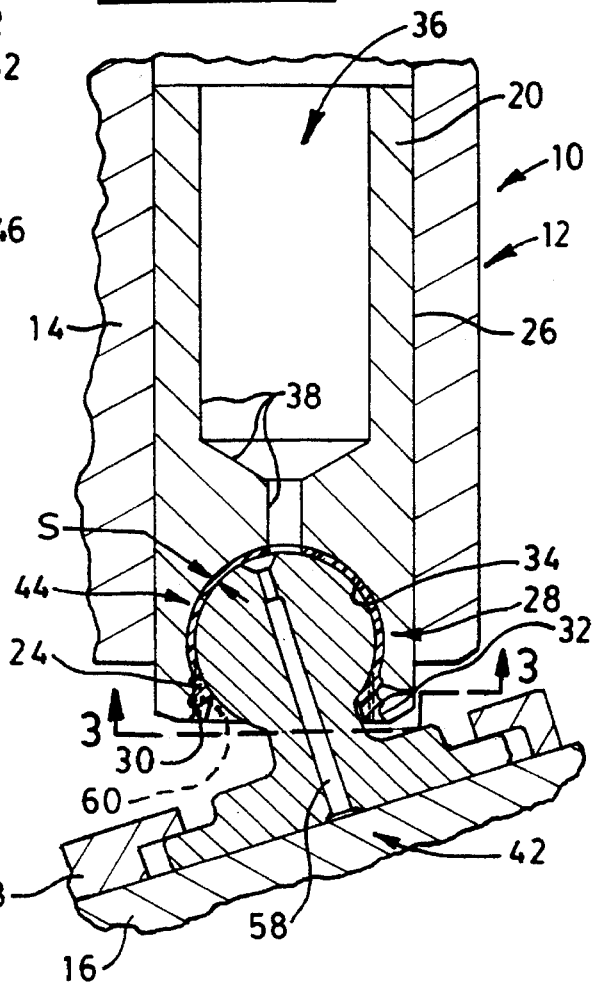
FIG. 2 is a diagrammatic representation of FIG. 1 illustrated in an operational mode and incorporating another embodiment of the present invention.
Figure 3:
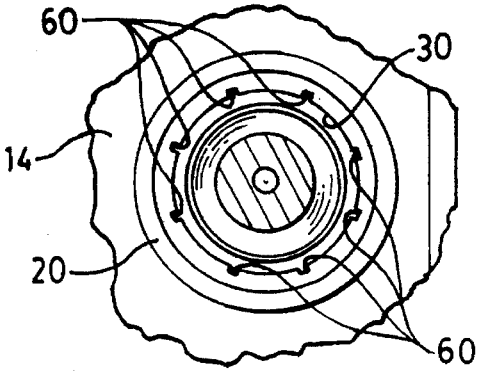
FIG. 3 is a sectional view taken along the line 3—3 of FIG. 2.

Referring to FIGS. 2 and 3, another embodiment of the piston assembly 10 is illustrated. The structure of FIGS. 2 and 3 are generally the same as the structure of FIG. 1 with the following exception. As more clearly illustrated in FIG. 3, a plurality of slots 60 are defined in the one end of the piston 20 and located in the cavity 28. Each slot of the plurality of slots 60 extend from the end of the piston 20 inwardly through the irregularly shaped annular surface 30 to the concave spherical surface 34. Each of the slots of the plurality of slots 60 interrupt the plurality of cylindrical grooves 32 with the open side of the slot opening into the cavity 28.

Figure 4:
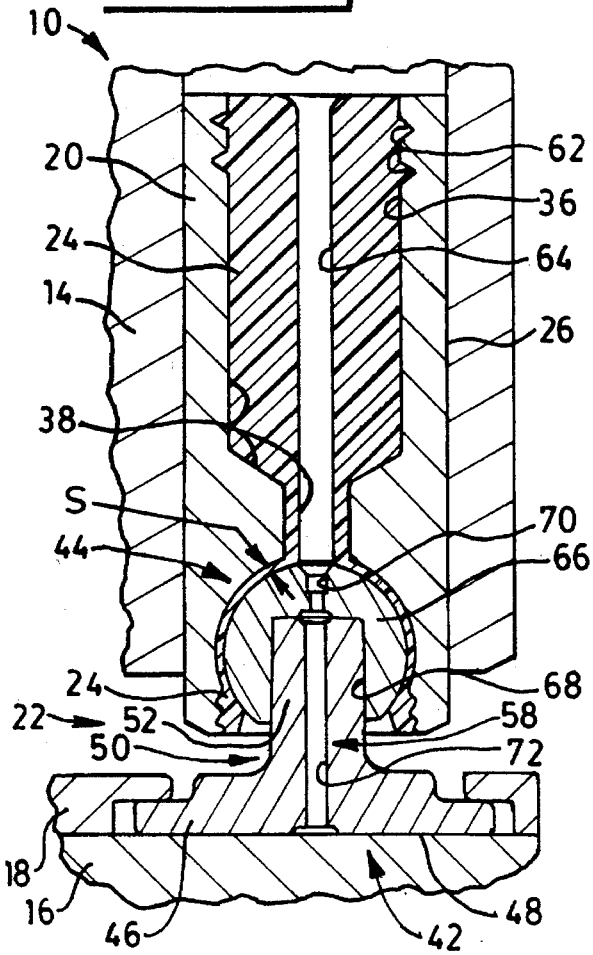
FIG. 4 is a diagrammatic representation of a piston assembly incorporating yet another embodiment of the subject invention.

Referring to FIG. 4, another embodiment of the piston assembly 10 is illustrated. All like elements have like element numbers. When comparing FIG. 4 with that of FIG. 1, the piston 20 illustrated herein has annular grooves 62 defined in the peripheral surface 38 of the opening 36. The annular grooves 62 are located generally near the other end of the piston 20.. The grooves 62 could be helically formed like threads, made in the form of slots, or could be in the form of bumps or protuberances extending from the peripheral surface 38. Furthermore, in the subject arrangement the plastic material 24 is also disposed in the opening 36 and the annular grooves 62. A fluid passageway 64 is defined in the plastic material 24 and extends from the other end of the piston 20 parallel with the longitudinal body 26 and opens into the cavity 28.

The head portion 54 of the second end portion 44 is a spherical ball 66 having a bore 68 defined in one end thereof and a passage 70 extending from the bottom of the bore 68 therethrough to the convex spherical surface 56. The first end portion 42 is composed of the base portion 46 and the neck portion 50 with the stem 52 extending from the neck portion 50. A passage 72 is defined in the first end portion 42 extending therethrough from the load bearing end surface 48 to the end of the stem 52. The passages 70 and 72 collectively make up the lube passage 58 in the slipper 22. The stem 52 is of a size sufficient to mate with the bore 68 and be bonded thereto in a conventional manner.

Figure 5:
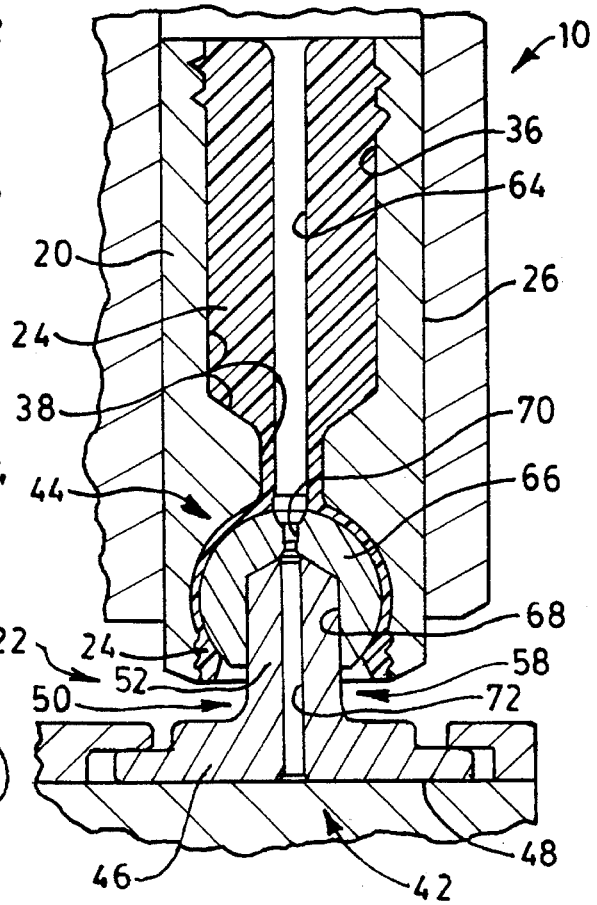
FIG. 5 is a diagrammatic representation of still another embodiment of a piston assembly incorporating the subject invention.

FIG. 5 is substantially the same structure as FIG. 4 with the exception that the stem 52 of the neck portion 50 has a tapered end as opposed to the flat end of the stem 52 illustrated in FIG. 4. Likewise, the bore 68 of the spherical ball 66 has a corresponding mating tapered surface at the bottom thereof to receive the tapered end of the stem 52. As with the embodiment of FIG. 4, the stem 52 is bonded in the bore 68 of the spherical ball 66.

Figure 6:
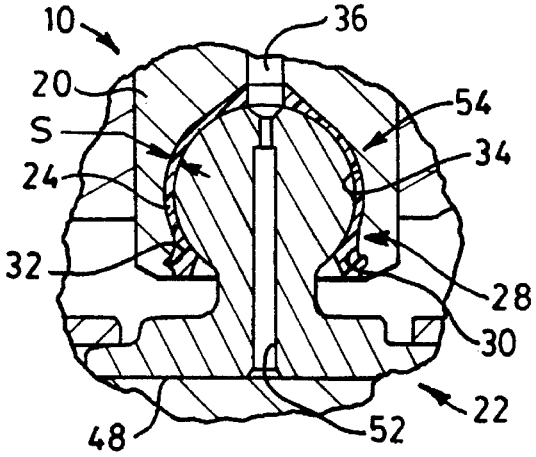
FIG. 6 is a part-section of a piston assembly of still another embodiment of the subject invention.

Referring to FIG. 6, a part-section of the piston assembly 10 is illustrated. The piston 20 includes the cavity 28 having the concave surface 34 and the irregularly shaped annular surface 30. The irregularly shaped annular surface 30 of the subject embodiment has only one annular groove 32 as opposed to the two illustrated in FIG. 1. Additionally, the concave surface 34 is not spherical as illustrated in the previous embodiments. The space "S" is larger in the area adjacent the opening 36. This larger space "S" adjacent the opening 36 aids in the injection molding process. It is recognized that the space "S" does not have to be uniform. In fact, it is recognized that the cavity 28 could have many different shapes.

Figure 7:
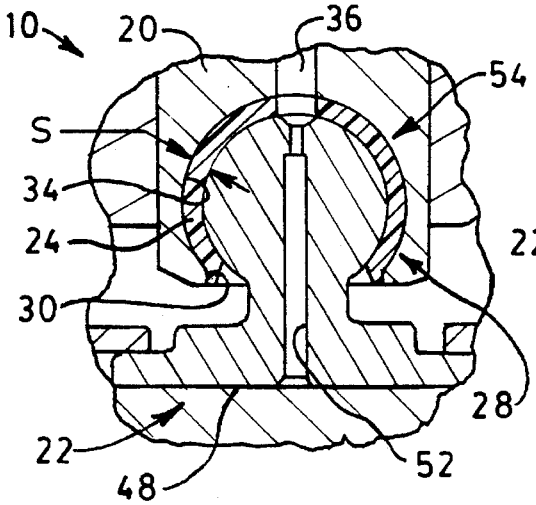
FIG. 7 is a part-section of still another embodiment of the subject invention.

Referring to FIG. 7, another part-section of the piston assembly 10 is illustrated. The piston 20 includes the cavity 28 having the concave surface 34 and the annular surface 30. In the subject embodiment, the annular surface 34 is uniform in shape and does not include any annular grooves 32. The head portion 54 of the slipper 22 is located in the cavity 28 to define the space "S". The space "S" of the subject embodiment is larger than the previous embodiments so that the volume of the plastic material 24 in the space "S" is sufficient to retain the head portion 54 in the cavity 28.

Figure 8:
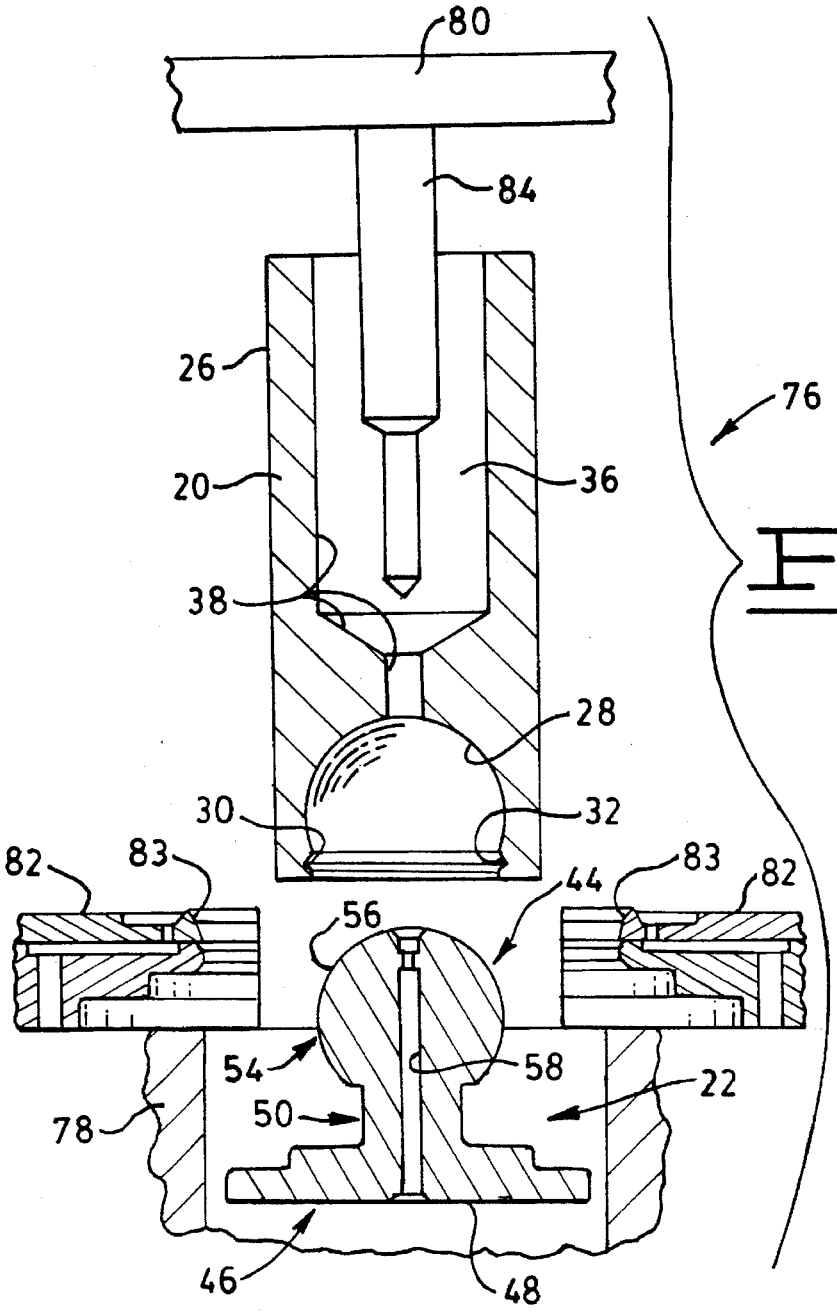
FIG. 8 is a diagrammatic representation of portions of an assembly mechanism and the components of the piston assembly in their unassembled condition.
Figure 9:
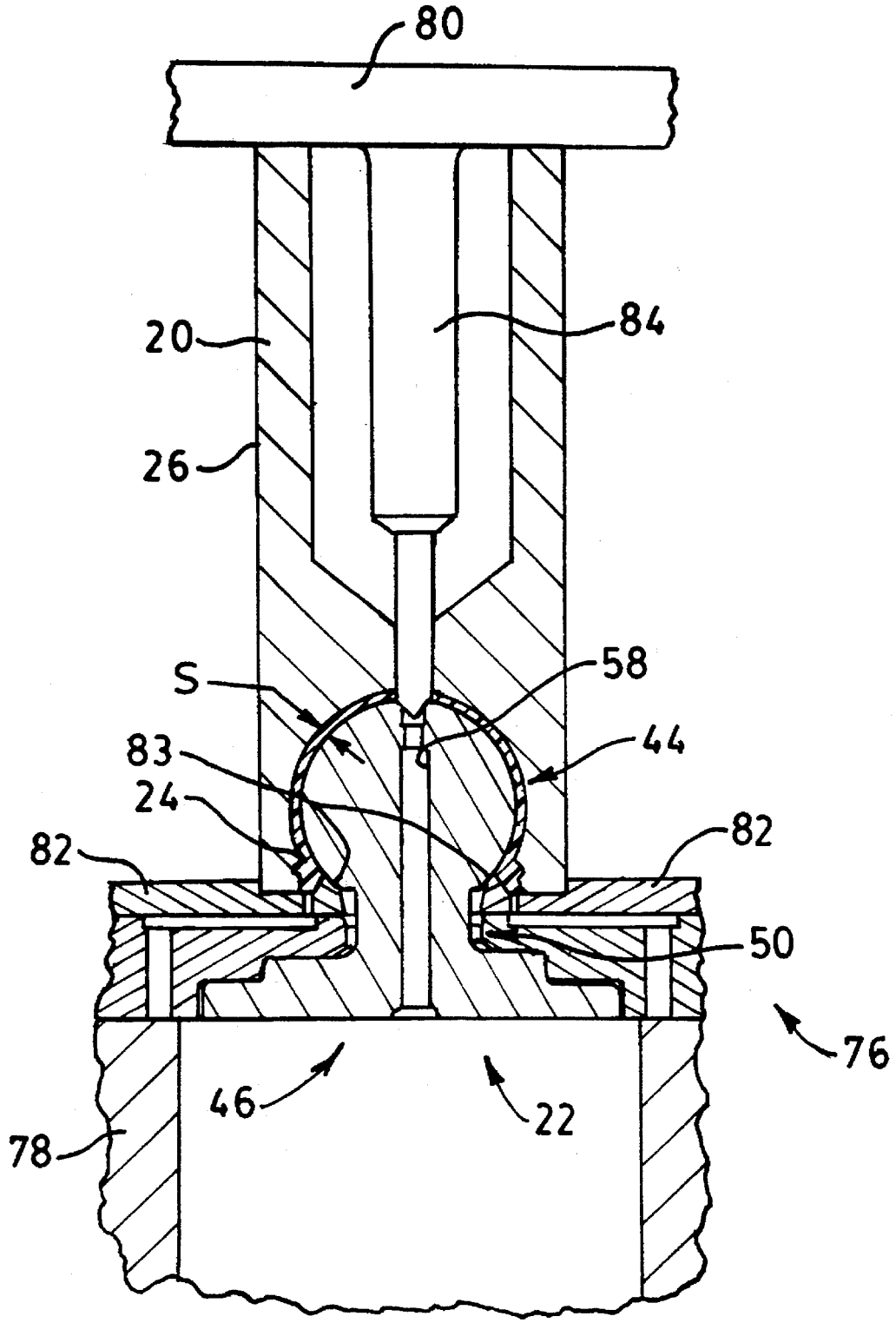
FIG. 9 is a diagrammatic representation of the portion of the assembly mechanism and the elements of the piston assembly in their assembled condition.

Referring to FIGS. 8 and 9, an apparatus is diagrammatically illustrated for assembling the slipper 22 to the piston 20. The apparatus includes a die assembly 76 having a first portion 78, a second portion 80 and a die mold 82. The die mold 82 is a split mold wherein the halves of the die mold are separated during the assembly process. The die mold 82 has a sealing and locating surface 83 disposed thereon and is operative to sealingly contact the head portion 54 of the slipper 22 and to aid in locating the head portion 54.

In the subject arrangement, the first and second portions 78,80 of the die assembly 76 are spaced apart for respectively inserting the slipper 22 and the piston 20 therein. The die mold 82 is of a structure sufficient for precisely positioning the slipper 22 relative to the piston 20. A pilot stem 84 is attached to the second portion 80 of the die assembly 76. The second portion 80 is moved toward the first portion 78 so that the end of the pilot stem 84 passes through the opening 36 of the piston 20 and contacts the end of the spherical head portion 54 at the lube passage 58. At the same time the other end of the piston 20 contacts the second portion 80. The end of the pilot stem 84 seals the lube passage 58 and aids in precisely positioning the slipper 22. The piston 20 is precisely located between the die mold 82 and the second portion 80 which results in the head portion 54 being precisely located in the cavity 28 to form the space "S". Once the head portion 54 is precisely located in the cavity 28, the plastic material 24 is injected through the die mold 82 into the space "S". After the plastic material 24 has been injected into the space "S", the halves of the die mold 82 are separated and the first and second portions 78,80 of the die assembly 76 are moved apart to permit removal of the completed piston assembly 10.

Figure 10:
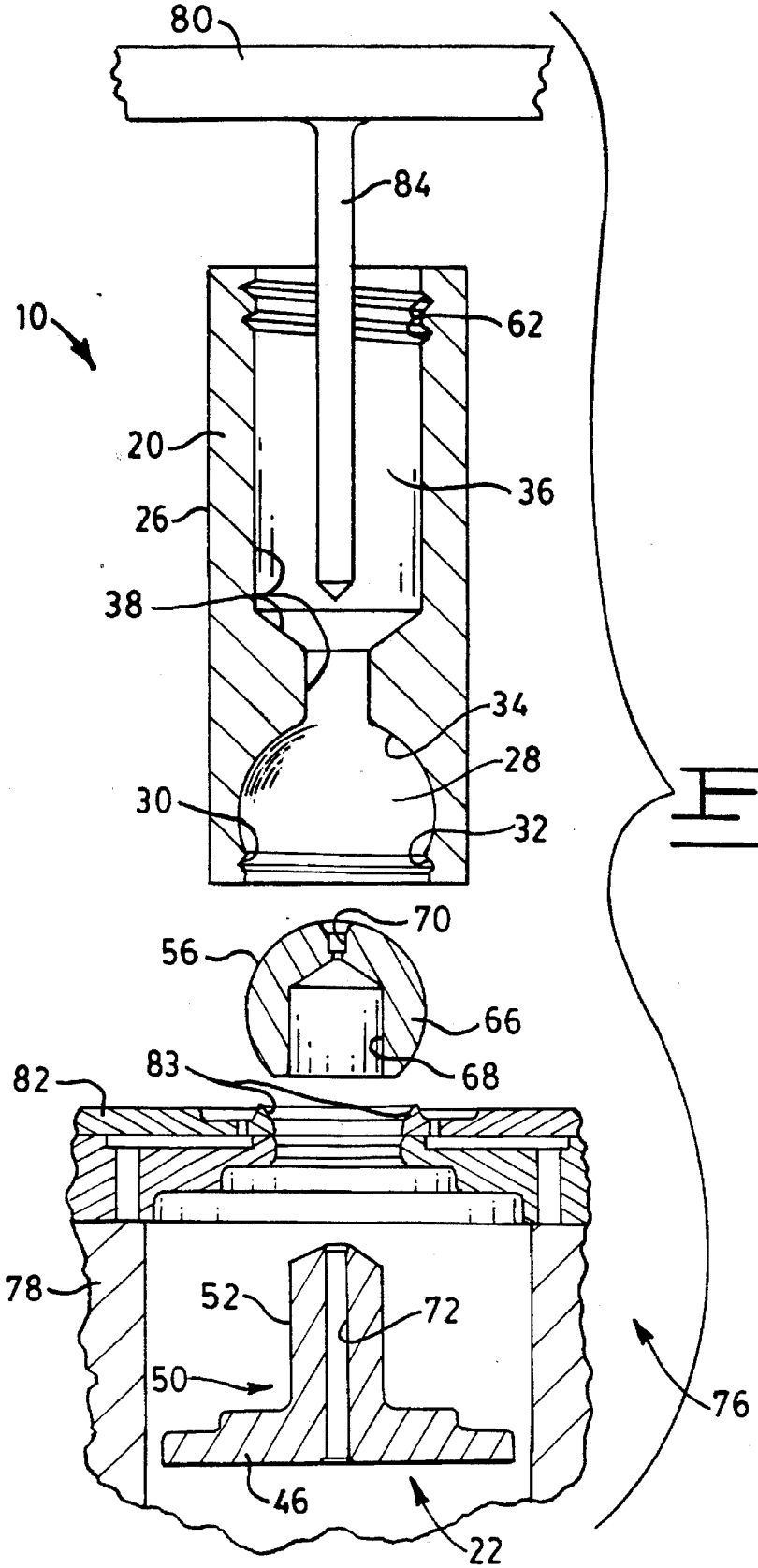
FIG. 10 is a diagrammatic representation of portions of another assembly mechanism and the elements of another piston assembly in their unassembled condition.
Figure 11:
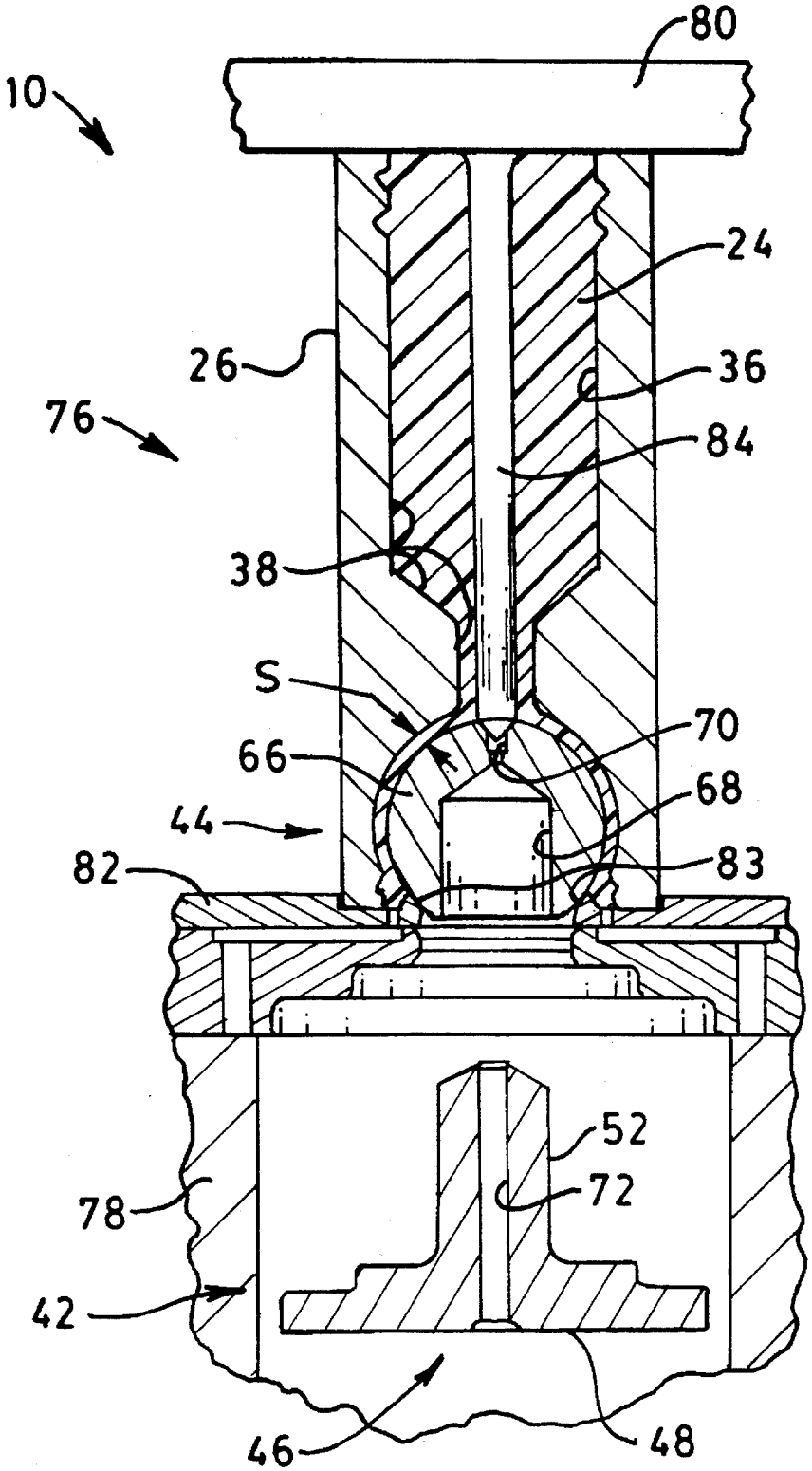
FIG. 11 is a diagrammatic representation of an intermediate step of assembling the components of FIG. 10.
Figure 12:
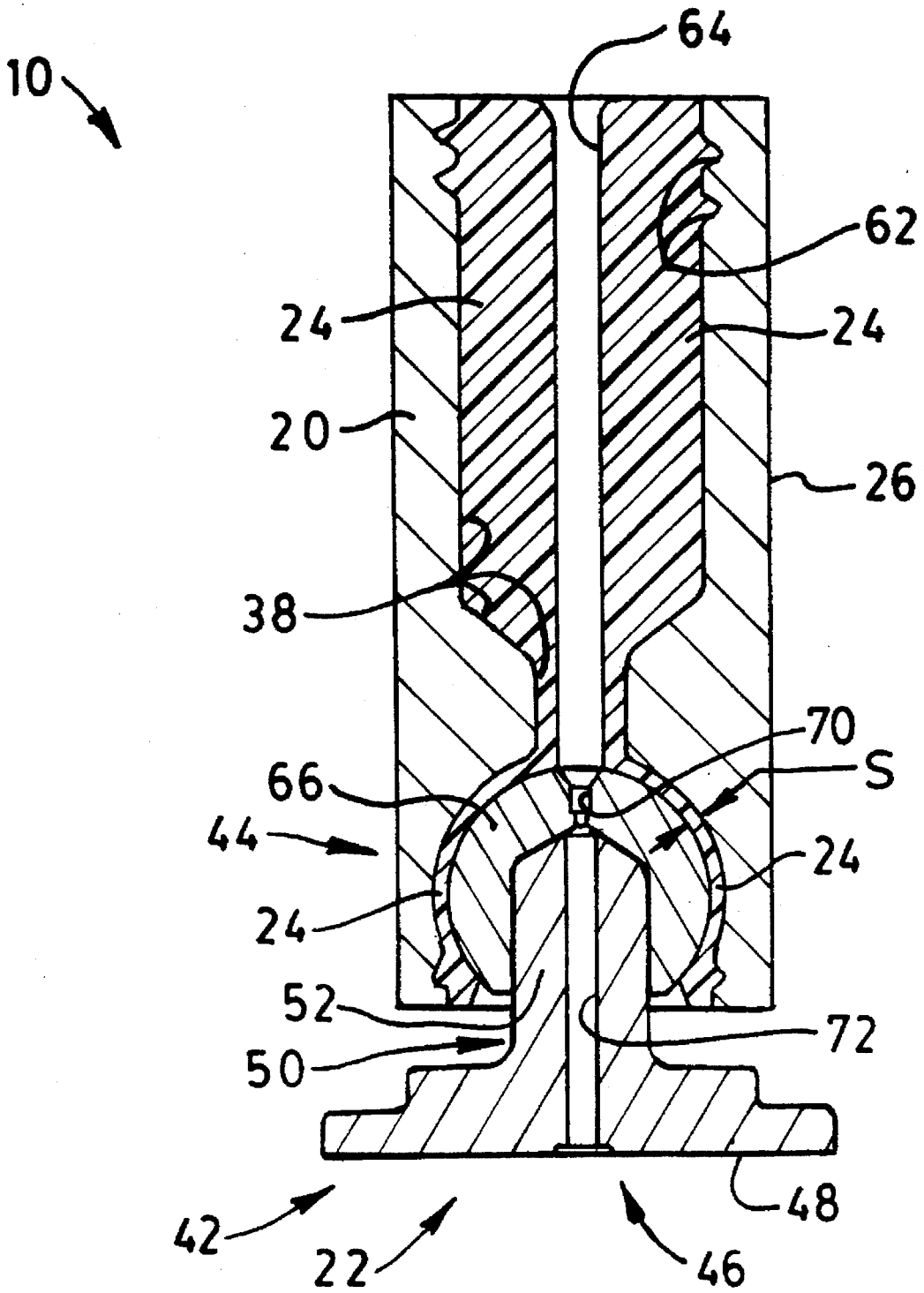
FIG. 12 is a diagrammatic representation of a fully assembled piston assembly of the components of FIG. 10.
Figure 13:
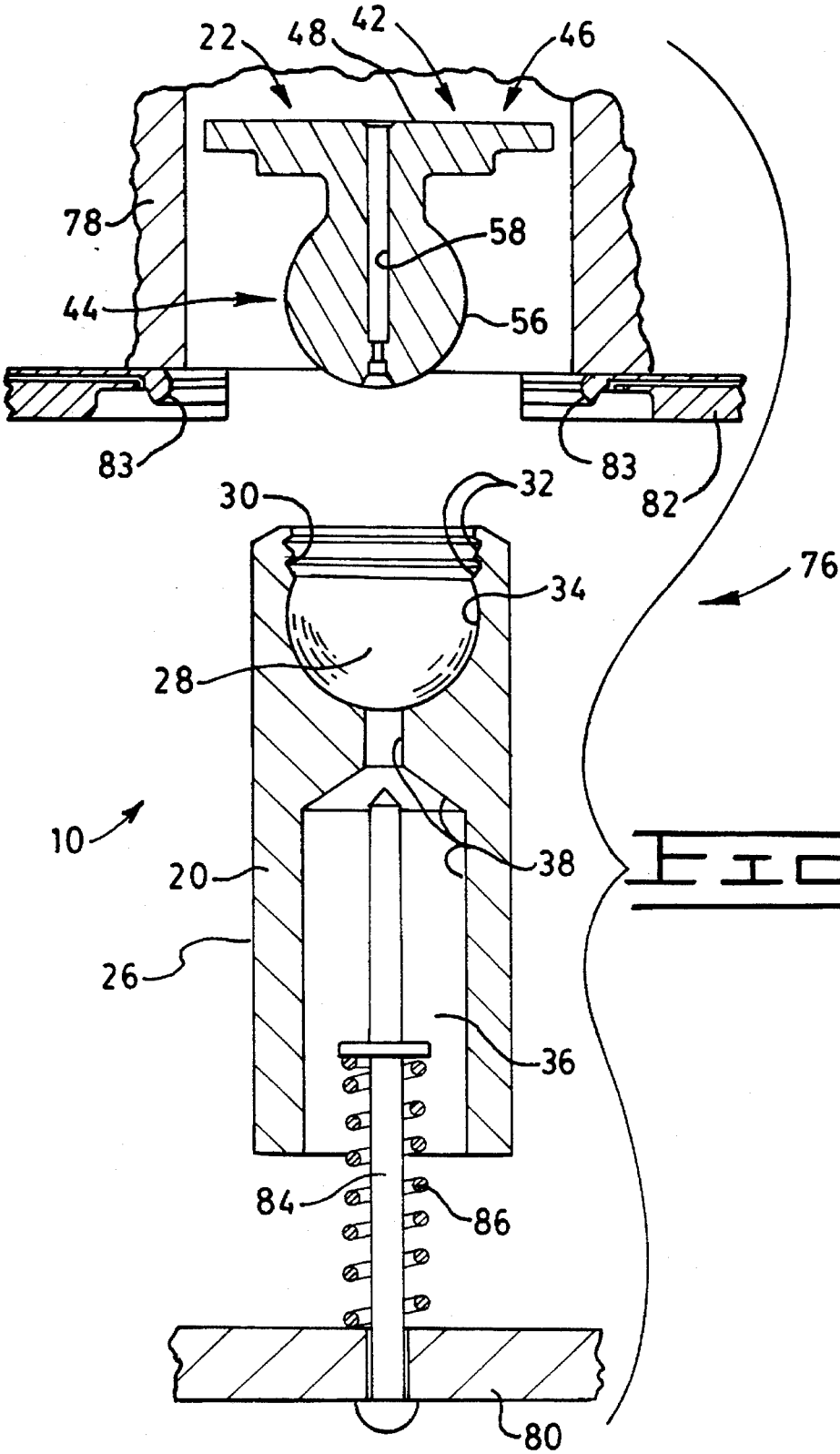
FIG. 13 is a diagrammatic representation of portions of yet another assembly mechanism and the elements of yet another piston assembly in their unassembled condition.
Figure 14:
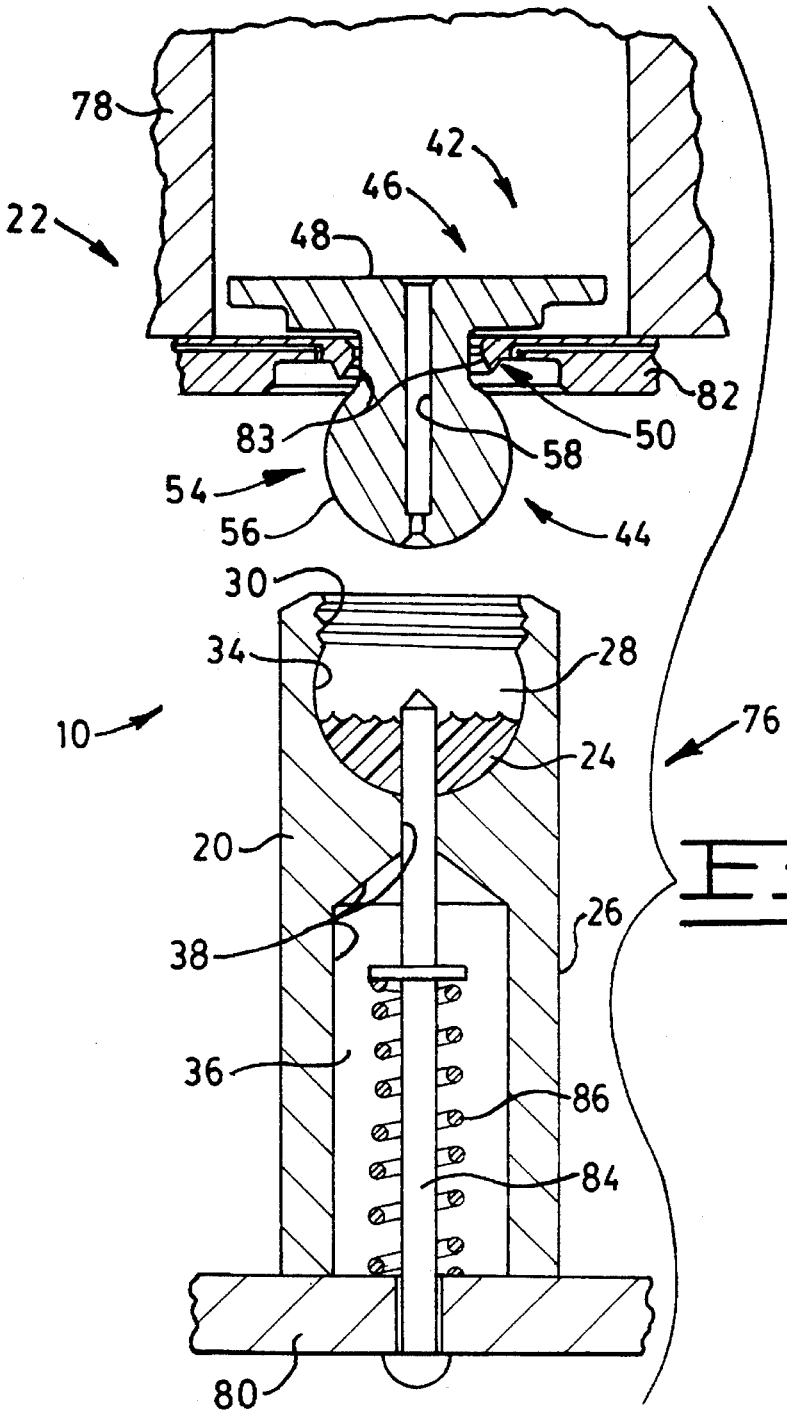
FIG. 14 is a diagrammatic representation of an intermediate step of the assembly of the components of FIG. 13.
Figure 15:
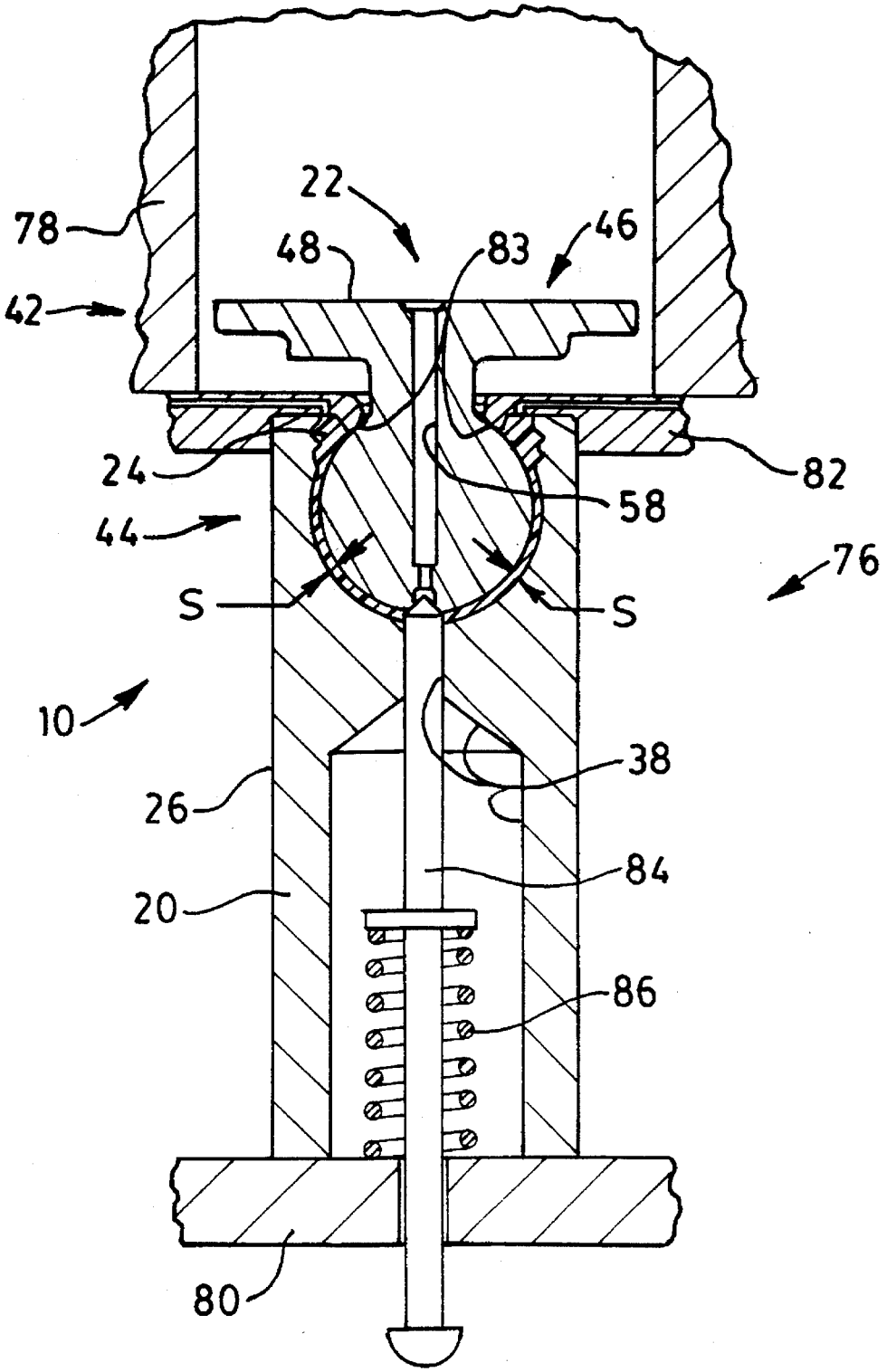
FIG. 15 is a diagrammatic representation of a subsequent step in the assembly of the components of FIG. 13.
Figure 16:
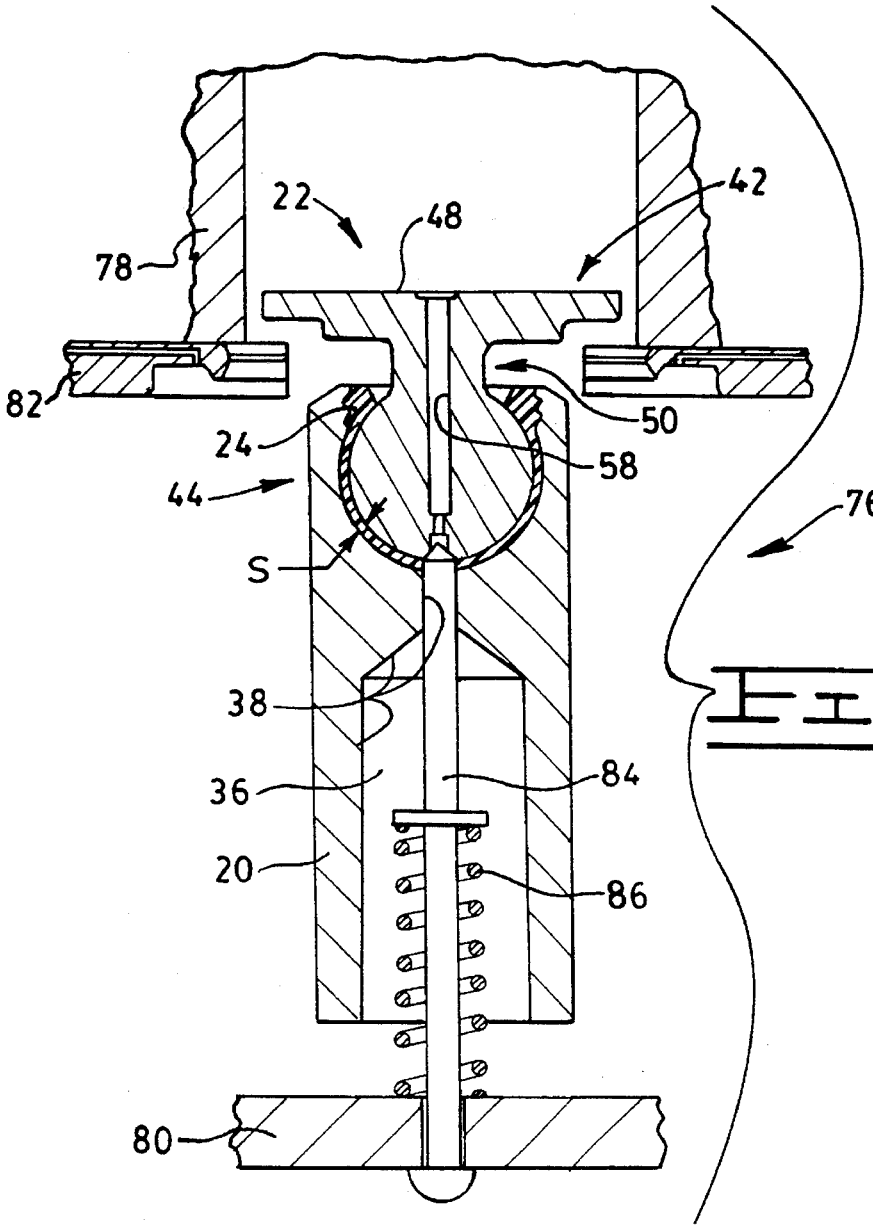
FIG. 16 is a diagrammatic representation of the fully assembled piston assembly of the components of FIG. 13.

Referring now to FIGS. 10, 11 and 12, another embodiment of the apparatus to assemble the components of the piston assembly 10 is illustrated. Like elements have like element numbers. The die assembly 76 of the subject embodiment includes the first portion 78, the second portion 80 having the pilot stem 84 and includes a one piece die mold 82 as opposed to the split die mold illustrated in FIGS. 8 and 9. The subject apparatus of FIGS. 8 through 10 is utilized for assembling the piston assembly 10 illustrated in FIGS. 4 and 5. In the subject arrangement, the spherical ball 66 is located in the die mold 82 with the convex spherical surface 56 placed in contact with the locating and sealing surface 83 which initially positions the spherical ball 66. The piston 20 is then placed over the spherical ball 66 and the end thereof is located in the die mold 82 followed by the second portion 80 of the die assembly 76 moving towards the first portion 78. The end of the pilot stem 84 enters the opening 36 and contacts the end of the spherical ball 66 at the passage 70 to precisely locate the spherical ball 66. The second portion 80 contacts the other end of the piston 20 to finally orient the piston 20 relative to the spherical ball 66.

In the subject arrangement, the opening 36 is larger than the pilot stem 84 so that once the plastic material 24 is injected into the space "S" the plastic material 24 likewise is injected into and fills the opening 36 and the annular groove 62. The area in the opening 36 that is displaced by the pilot stem 84 provides a fluid passageway 64 once the piston assembly 10 is removed from the die assembly 76. Even though in the subject arrangement the plastic material is simultaneously injected into the space "S" and also into the opening 36, it is recognized that without departing from the essence of the invention the plastic material 24 could be injected into the space "S" as one step and in another step the plastic material 24 is injected into the opening 36. Likewise, the plastic material 24 could be injected from the other end of the piston 20 to fill both the opening 36 and the space "S" at the same time. Once the plastic material 24 has been injected into the space "S" and the opening 36, the first and second portions 78,80 of the die assembly 76 are separated in order to remove the assembled piston 20 and the spherical ball 66. After removal of the partial assembly from the die assembly 76, the stem 52 of the base portion 46 is bonded into the bore 68 of the spherical ball 66 to complete the assembly of the piston assembly 10 as illustrated in FIG. 12.

Referring now to FIGS. 13 through 16, another embodiment of the assembly of the piston assembly 10 is diagrammatically illustrated. In this arrangement, the die assembly 76 includes the first portion 78, the second portion 80, the split die mold 82 having the locating and sealing surface 83 and the pilot stem 84 attached to the second portion 80. In the subject arrangement, the pilot stem 84 is movably connected to the second portion 80 so that once the end of the pilot stem 84 contacts the end of the slipper 22, further closing force of the first portion 78 moving towards the second portion 80 causes the end of the pilot stem 84 to move against the bias of a spring 86.

During the assembly, the piston 20 is placed over the pilot stem 84 so that the end of the pilot stem 84 extends through the opening 36 into the cavity 28 until the other end of the piston 20 contacts the second portion 80 of the die assembly 76. The slipper 22 is then positioned in the first portion 78 of the die assembly 76 with the head portion 54 extending outwardly away from the die mold 82. The split die mold 82 is closed so that the locating and sealing surfaces 83 are in close proximity to the convex spherical surface 56 of the head portion 54. A predetermined quantity of a thermo-setting plastic is placed in the cavity 28 followed by the first portion 78 being moved towards the second portion 80 such that the head portion 54 is moved into the cavity 28. Initially, the end of the head portion 54, at the lube passage 58, contacts the end of the pilot stem 84 to force the head portion 54 against the locating and sealing surfaces 83 to precisely locate the head portion 54. Further movement of the first portion 78 towards the second portion 80 results in the pilot stem 84 being forced in a direction out of the cavity 28 as the head portion 54 is being progressively moved into the cavity 28. The head portion 54 of the slipper 22 is moved into the cavity 28 forcing the thermo-setting plastic to flow around the convex spherical surface 56 filling the space "S". Once the thermo-setting plastic has solidified, the first and second portions 78,80 are separated and the split die mold 82 is opened in order to remove the fully assembled piston assembly 10.

It is recognized that various forms of the piston assembly 10 could be utilized without departing from the essence of the invention. For example, the opening 36 in each of the embodiments could be filled with the plastic material 24 or conversely the opening 36 could remain free from being filled with the plastic material 24. Likewise, the slipper 22 in each of the embodiments could be a one piece slipper 22 as illustrated in FIGS. 1 and 2 or of a two piece design as illustrated in FIGS. 4 and 5. Furthermore, the plurality of slots 60 as illustrated in FIGS. 2 and 3 could be utilized in each of the other embodiments. Additionally, the plurality of slots 60 could be eliminated from FIGS. 2 and 3. Also, the thermo-setting material 24 need not be of low viscosity. It could, for instance, be a preformed ring with the consistency of modeling clay. It is further recognized, that various forms of the die assembly 76 could be utilized in assembling the components of the piston assembly 10. The diagrammatic representations of the die assembly 76 is for illustrative purposes only. It is well recognized that one skilled in the art could utilize various other details in the structure of the die assembly 76 but the process needed is generally set forth in the embodiments as illustrated in FIGS. 8 through 16.

Industrial Applicability

During the assembly of the piston 20 and slipper 22 as illustrated in FIG. 1, the head portion 54 of the slipper 22 is precisely placed in the cavity 28 to define the space "S" between the concave spherical surface 34 of the cavity 28 and both the convex spherical surface 56 and the irregularly cylindrical surface 30. The die assembly 76 is utilized to hold the piston 20 relative to the slipper 22 and the locating and sealing surfaces 83 of the die mold 82 is utilized to aid in positioning the head portion 54 and to close the cavity 28 for subsequent filling with the plastic material 24. Once the plastic material 24 is injected into the closed space "S" between the head portion 54 and the cavity 28, the piston assembly 10 is complete. The plurality of cylindrical grooves 32 are utilized to aid in providing a resistance of the plastic material 24 slipping from the cavity 28 since the plastic material 24 would have to be sheared in order for it to slide from the cavity 28. Consequently, the head portion 54 is positively retained in the cavity 28 by the plastic material 24.

It has been determined by test pieces being made that a mold release agent between the metal of the head portion 54 and the injected plastic is not needed. However, in some applications it could be necessary to coat the surface of the head portion with the mold release agent prior to injection of the plastic material 24 in order to avoid the plastic material sticking to the head portion. Mold release agents are readily available on the market if it is deemed necessary to provide such a mold release agent.

There are various types of plastic materials that could be utilized in the subject invention. Two types that has been successfully used are polyetherketoneketone (PEKK) compound number 4199X62677NAT/BLK and polyetherketoneetherketoneketone (PEKEKK) compound number 3999X63734NAT/BLK. Each of these plastic compounds are marketed by RTP Company located in Winona, Minn. RTP Company produces another plastic compound entitled polyetheretherketone (PEEK) that could possibly be utilized in the subject invention.

Referring to the embodiment illustrated in FIGS. 2 and 3, they are substantially the same as that illustrated in FIG. 1. However, in FIGS. 2 and 3 the plurality of slots 60 are disposed in the cavity 28 adjacent the end of the piston 20 and each slot of the plurality of slots 60 interrupt the plurality of cylindrical grooves 32. Once the plastic material 24 is injected into the closed space "S", the plurality of slots 60 are likewise filled with plastic material which aids in eliminating any tendency of the plastic material 24 rotating within the cavity 28. The plurality of slots 60 serve as anti-rotational locks for the plastic material 24. Even though a plurality of slots are illustrated for anti-rotational locks, it is recognized that other types of locks could be used, such as, slots extending into the cavity or dimples in the cavity.

Referring to FIGS. 4 and 5, the spherical ball 66 is precisely located in the cavity 28 relative to the piston 20 by the locating and sealing surfaces 83 of the die mold 82 and the end of the pilot stem 84. Once the piston 20 and the spherical ball 66 are properly located, the closed space "S" and the opening 36 are filled with the plastic material 24. The plastic material 24 in the closed space "S" serves to retain the spherical ball 66 in the cavity 28. As is well known in the art, it is advantageous to reduce the weight of the piston 20 by providing the opening 36. Likewise, it is well known to fill the opening 36 with a lightweight material to reduce the volume of unused fluid that would otherwise fill the opening 36. The plastic material 24 in the opening 36 of the subject invention serves the above-noted purpose of eliminating the volume of unused fluid in the opening 36. Once the spherical ball 66 is secured within the cavity 28, the stem 52 of the base member 46 is bonded in the bore 68 of the spherical ball 66 to complete the final assembly of the piston assembly 10. Many different bonding agents may be utilized to bond the base portion 46 to the spherical ball 66. One such bonding agent that is readily available is Cat Epoxy 77 marketed by Caterpillar Incorporated.

Referring to FIGS. 6 and 7, the additional embodiments illustrate that there are various shapes and sizes of the cavity 28 and the space "S" that can be utillized to retain the head portion 54 in the cavity 28 without departing from the essence of the invention.

Referring to FIGS. 8 and 9, the method of assembling the piston assembly 10 illustrated in FIGS. 1–3 comprises the steps of precisely positioning the head portion 54 of the slipper 22 into the first portion 78 and the die mold 82 followed by closing the die mold 82 so that the locating and sealing surface 83 contacts the convex spherical surface 56 of the head portion 54 generally adjacent the neck portion 50. This locates the head portion 54 in the cavity 28 of the piston 20. The end of the piston 20 is located in the die mold 82 followed by moving the second portion 80 of the die assembly 76 towards the first portion 78. This movement directs the pilot stem 84 through the opening 36 in the piston 20 until the end of the pilot stem 84 contacts the end of the head portion 54 at the lube passage 58 to precisely position the head portion 54 in the cavity 28 relative to the piston 20. The plastic material 24 is injected into the space "S" between the head portion and the cavity 28 and into the plurality of annular grooves 32 for positively retaining the head portion 54 in the cavity 28. The completed piston assembly 10 is then removed from the die assembly 76.

Referring to FIGS. 10, 11 and 12, another embodiment of the method for assembling the piston assembly 10 includes placing the spherical ball 66 into the die mold 82 so that the outer spherical surface 56 contacts the locating and sealing surface 83 and the bore 68 faces towards the first portion 78 of the die assembly 76, positioning the cavity 28 of the piston 20 over the spherical ball 66 and lowering the piston 20 until the end of the piston 20 contacts the die mold 82, lowering the pilot stem 84 through the opening 36 of the piston 20 until the end of the pilot stem 84 contacts the outer end of the spherical head 66 at the passage 70 to precisely locate the spherical head 66 relative to the piston 20, locating the other end of the piston 20 by the other end contacting the second end portion 80 of the die assembly 76, and injecting the plastic material 24 into the closed space "S" and the opening 36 until the space "S" and the opening 36 are filled with the plastic material 24. Once the plastic material 24 has solidified, the second portion 80 is moved away from the first portion 78 to remove the pilot stem 84 from the piston 20. Once the pilot stem 84 has been removed, the fluid passageway 64 is provided in the plastic material 24 and extends from the cavity 28 to the other end of the piston 20. Following removal of the assembled piston 20 and the spherical head 66 from the die assembly 76, the stem 52 extending from the base portion 46 is inserted into the bore 68 of the spherical head 66 and bonded thereto. This completes the assembly of the piston assembly 10.

Referring to FIGS. 13–16, another embodiment of the method for assembling the piston assembly 10 is set forth. In the subject embodiment, the piston 20 is placed over the spring biased pilot stem 84 until the other end of the piston 20 contacts the second portion 80 of the die assembly 76 and the end of the spring biased pilot stem 84 is located within the cavity 28, the slipper 22 is positioned in the first portion 78 of the die assembly 76 such that upon closing of the die mold 82 the head portion 54 extends outwardly away from the first portion 78 of the die assembly 76, a predetermined quantity of thermo-setting plastic material 24 is placed in the cavity 28 around the end of the spring loaded pilot stem 84, the first portion 78 is moved towards the second portion 80 and the end of the head portion 54 contacts the end of the spring biased pilot stem 84 at the lube passage 58 causing the head portion 54 of the slipper 22 to move toward and contact the locating and sealing surface 83 to precisely position the head portion 54 of the slipper 22, and the first portion 78 continues to move toward the second portion 80 against the bias of the spring 86 until the head portion 54 has been precisely located within the cavity 28 and the thermo-setting plastic has been forced to flow around the head portion 54 and into the plurality of annular grooves 32. Following solidification of the thermo-setting plastic 24, the die mold 82 is released along with the first portion 78 of the die assembly 76 being moved away from the second portion 80 and the force of the spring 86 forces the pilot stem 84 back to its initial position moving the fully assembled piston assembly 10 away from the second end portion 80. The fully assembled piston assembly 10 is then removed.

In view of the foregoing, it is readily apparent that the above described apparatus and method provides a piston assembly 10 that eliminates the problem of sliding friction between the movable elements of the piston assembly and reduces the precise sizing needed to produce the relative movable parts.

Other aspects, objects and advantages of this invention can be obtained from a study of the drawings, the disclosure and the appended claims.

I claim:

1. A piston assembly for a fluid translating device, comprising:

a piston operative to reciprocate within the fluid translating device and having a longitudinally extending body with a cavity defined in one end thereof, the cavity having an irregularly shaped annular surface adjacent the end of the piston and a concave surface extending inwardly from the irregularly shaped annular surface;

a slipper having a first end portion with a load bearing end surface and a neck portion and a second end portion with a larger head portion extending from the neck portion, the head portion having a convex spherical surface and is disposed in the cavity with the convex spherical surface thereof being at a predetermined space from the concave surface of the cavity; and a plastic material formed in the cavity during assembly and extends inwardly from the end of the piston filling the predetermined space defined between the cavity and a portion of the convex spherical surface, the plastic material being the only element that both permits the head portion of the slipper to pivot in the cavity of the piston and to solely retain the head portion of the slipper in the cavity of the piston.

2. The piston assembly of claim 1 wherein the irregularly shaped annular surface has an annular groove defined therein adjacent the end of the piston.

3. The piston assembly of claim 2 wherein the irregularly shaped annular surface has a plurality of annular grooves defined therein.

4. The piston assembly of claim 2 wherein the first end portion of the slipper is composed of a base portion having the load bearing end surface with a stem extending from the neck portion, and the head portion of the second end portion is composed of a spherical ball having a hole defined therein of a size sufficient to receive the stem for bonding therein.

5. The piston assembly of claim 4 wherein the concave surface is a spherical concave surface and a plurality of slots are defined in the piston and located in the cavity, the plurality of slots extend from the end of the piston through the irregularly shaped annular surface to the spherical concave surface.

6. The piston assembly of claim 5 wherein the load bearing end surface of the slipper is a substantially flat end surface.

7. The piston assembly of claim 6 wherein the slipper has a lube passage defined therethrough extending from the load bearing surface to the convex spherical surface, the piston has an opening defined therein extending from the other end thereof to communicate with the lube passage, the opening has a peripheral surface extending along its entire length and the plastic material formed in the cavity extends into the opening and is formed along the entire length of the peripheral surface and defines a fluid passageway therethrough communicating with the lube passage in the slipper.

* * * * *